US010357866B2

(12) United States Patent
Wolk

(10) Patent No.: US 10,357,866 B2
(45) Date of Patent: Jul. 23, 2019

(54) METHOD AND DEVICE FOR THE SURFACE FINISHING OF WORKPIECES

(71) Applicant: OTEC PRÄZISIONSFINISH GMBH, Straubenhardt-Feldrennach (DE)

(72) Inventor: Walfried Wolk, Keltern (DE)

(73) Assignee: OTEC PRÄZISIONSFINISH GMBH, Straubenhardt-Feldrennach (DE)

( * ) Notice: Subject to any disclaimer, the term of this patent is extended or adjusted under 35 U.S.C. 154(b) by 495 days.

(21) Appl. No.: 14/771,328

(22) PCT Filed: Mar. 26, 2014

(86) PCT No.: PCT/EP2014/000808

§ 371 (c)(1),
(2) Date: Aug. 28, 2015

(87) PCT Pub. No.: WO2014/166594

PCT Pub. Date: Oct. 16, 2014

(65) Prior Publication Data

US 2016/0016277 A1 Jan. 21, 2016

(30) Foreign Application Priority Data

Apr. 9, 2013 (DE) ..... 10 2013 006 010
Sep. 27, 2013 (DE) ..... 10 2013 016 053

(51) Int. Cl.
*B24B 31/00* (2006.01)
*B24B 31/02* (2006.01)
*B24B 31/027* (2006.01)

(52) U.S. Cl.
CPC ..... *B24B 31/003* (2013.01); *B24B 31/00* (2013.01); *B24B 31/006* (2013.01); *B24B 31/02* (2013.01); *B24B 31/027* (2013.01)

(58) Field of Classification Search
CPC ..... B24B 31/00; B24B 31/003; B24B 31/006; B24B 31/02; B24B 31/027
(Continued)

(56) References Cited

U.S. PATENT DOCUMENTS 2,664,676 A * 1/1954 Cuppers ..... B24B 31/003 134/134
3,570,184 A * 3/1971 Ferrara ..... B08B 7/02 451/113
(Continued)

FOREIGN PATENT DOCUMENTS

CN 1607066 A 4/2005
CN 101314213 A 12/2008
(Continued)

*Primary Examiner* — Eileen P Morgan
(74) *Attorney, Agent, or Firm* — McGlew and Tuttle, P.C.

(57) ABSTRACT

A method for the surface finishing of workpieces moves the workpiece, including rotating about at least one axis, relative to a bed of a granular grinding and/or polishing material. The workpiece is accelerated to different speeds of rotation in relation to the bed of the granular grinding/polishing material. The workpiece or a container containing the bed of granular grinding/polishing material to be accelerated in periodic cycles of at most 5 sec between speeds of rotation and a second speed of rotation and/or to be rotated during continual acceleration at continually different speeds of rotation. A device for carrying out the method, such as a drag- or dip-finishing machine, includes a control device to impose speed of rotation profiles of the aforementioned type on a rotary drive workpiece holders, on which the workpieces can be clamped, or on a container containing the bed of granular material during the operation.

23 Claims, 3 Drawing Sheets

(58) Field of Classification Search
USPC ..... 451/32, 34, 35, 104, 106, 113, 114
See application file for complete search history.

(56) References Cited

U.S. PATENT DOCUMENTS

| | | | | | |
|---|---|---|---|---|---|
| 4,173,851 | A * | 11/1979 | Higashi | B24B 31/003 | 451/113 |
| 4,205,487 | A * | 6/1980 | Anderson | B24B 31/003 | 279/43 |
| 4,240,229 | A * | 12/1980 | Ohno | B24B 31/003 | 451/106 |
| 4,280,302 | A * | 7/1981 | Ohno | B24B 31/0224 | 451/113 |
| 4,446,656 | A * | 5/1984 | Kobayashi | B24B 31/064 | 451/113 |
| 4,747,233 | A * | 5/1988 | Kobayashi | B24B 31/0224 | 451/113 |
| 5,251,409 | A * | 10/1993 | Orbank | B24B 31/003 | 451/113 |
| 5,857,901 | A * | 1/1999 | LaPoint | B24B 31/003 | 451/113 |
| 6,080,052 | A * | 6/2000 | Renter | B24B 31/00 | 451/326 |
| 6,261,154 | B1 * | 7/2001 | McEneny | B24B 29/02 | 451/32 |
| 6,280,303 | B1 * | 8/2001 | Kawasaki | B24B 31/003 | 451/104 |
| 6,406,356 | B1 * | 6/2002 | Brooks | B24B 31/003 | 451/104 |
| 6,572,458 | B2 * | 6/2003 | Lim | B24B 31/003 | 451/106 |
| 6,688,953 | B2 * | 2/2004 | Kawasaki | B24B 1/00 | 451/106 |
| 6,918,818 | B2 * | 7/2005 | Rudiger | B24B 31/003 | 451/106 |
| 6,962,522 | B1 * | 11/2005 | Kawasaki | B24B 31/003 | 451/104 |
| 6,991,522 | B2 | 1/2006 | Yanagimoto et al. | | |
| 7,118,464 | B2 * | 10/2006 | Bolz | B24B 1/00 | 451/104 |
| 7,144,302 | B2 * | 12/2006 | Bolz | B24B 31/0224 | 451/36 |
| 9,550,272 | B2 * | 1/2017 | Sroka | B24B 31/003 | |
| 2003/0216110 | A1 * | 11/2003 | Bohm | B24B 31/003 | 451/36 |
| 2004/0045408 | A1 | 3/2004 | Hoffman | | |
| 2004/0064947 | A1 | 4/2004 | Yanagimoto et al. | | |
| 2004/0242134 | A1 * | 12/2004 | Lee | B24B 31/003 | 451/113 |
| 2005/0136802 | A1 * | 6/2005 | Rudiger | B24B 31/003 | 451/36 |
| 2005/0186889 | A1 * | 8/2005 | McNeil | B24B 31/003 | 451/36 |
| 2007/0238397 | A1 * | 10/2007 | Dyer | B24B 31/003 | 451/36 |
| 2012/0021674 | A1 * | 1/2012 | Schroeter | B24B 31/06 | 451/28 |
| 2014/0227944 | A1 * | 8/2014 | van Kleef | B24B 31/003 | 451/36 |

FOREIGN PATENT DOCUMENTS

| | | | |
|---|---|---|---|
| CN | 102574264 | A | 7/2012 |
| CN | 102990501 | A | 3/2013 |
| DE | 200 05 361 | U1 | 6/2000 |
| DE | 102 04 267 | C1 | 4/2003 |
| DE | 20 2009 008 070 | U1 | 9/2009 |
| DE | 10 2009 021 824 | A1 | 11/2010 |
| DE | 10 2010 052 222 | A1 | 5/2012 |
| DE | 10 2011 015 750 | A1 | 10/2012 |
| DE | 10 2011 103 606 | A1 | 12/2012 |
| EP | 1 362 669 | A2 | 11/2003 |
| EP | 2 572 829 | A1 | 3/2013 |
| JP | S59-24952 | A | 2/1984 |
| JP | S60-143620 | A | 7/1985 |
| JP | 2004-340380 | A | 12/2004 |
| WO | 2010/132396 | A1 | 11/2010 |
| WO | 2012/069169 | A2 | 5/2012 |

* cited by examiner

METHOD AND DEVICE FOR THE SURFACE FINISHING OF WORKPIECES

CROSS REFERENCE TO RELATED APPLICATIONS

This application is a United States National Phase Application of International Application PCT/EP2014/000808 filed Mar. 26, 2014 and claims the benefit of priority under 35 U.S.C. § 119 of German Patent Applications 10 2013 006 010.9 filed Apr. 9, 2013 and 10 2013 016 053.7 filed Sep. 27, 2013 the entire contents of which are incorporated herein by reference.

FIELD OF THE INVENTION

The present invention pertains to a method for the surface finishing of workpieces, by the workpiece being moved relative to a bed of granular grinding and/or polishing material, wherein the workpiece is rotated in relation to the bed of granular grinding and/or polishing material about at least one axis, wherein the workpiece is accelerated to different speeds of rotation in relation to the bed of granular grinding and/or polishing material. The present invention pertains, furthermore, to a device suitable especially for carrying out such a method for the surface finishing of workpieces by moving the workpiece relative to a bed of granular grinding and/or polishing material, with at least one workpiece holder for detachably fastening a workpiece to be finished and optionally with a container for receiving the granular grinding and/or polishing material, wherein at least one rotary drive is associated with the workpiece holder and/or with the container, and the device comprises, furthermore, a program-based control device, which is capable of controlling at least the rotary drive of the workpiece holder and/or the rotary drive of the container.

BACKGROUND OF THE INVENTION

Such devices for the surface finishing of workpieces with the use of a granular grinding and/or polishing medium are known, for example, in the form of so-called dragging and dipping finishing machines. Their mode of action is based on the fact that the workpiece to be finished is dipped into a bed of granular grinding and/or polishing material, which is contained in a container, and the workpiece is moved relative to the granular material, especially by a rotary motion as well as optionally by translatory motion, as a result of which the surface of the workpiece is ground and/or polished, depending on the type of the granular material. Drag-finishing and dip-finishing machines represent a special form of slide-grinding machines, wherein the workpieces to be finished can be clamped, e.g., individually, on one or more workpiece holders rotatable about its/their axis by means of a rotary drive. To move the workpieces by a translatory motion relative to the granular grinding and/or polishing material, prior-art drag-finishing machines often comprise a usually rotating part essentially in the form of a plate, which is driven rotatingly, e.g., by a motor via a suitable gear mechanism, and on which the workpiece holders are fixed directly or indirectly, e.g., via lifting device. This happens especially eccentrically in relation to the axis of rotation of the rotating part of the drag-finishing machine. If this part, the so-called plate, of the drag-finishing machine is rotated, the workpiece holders fixed thereon describe a trajectory. The workpieces being carried by the workpiece holders are now dipped into the working container, which is filled with the bed of particulate granular grinding or polishing material, often with liquid finishing media, such as water, surfactants, etc., added. Based on the relative motion of the workpieces in relation to the granular material, the surface finishing of the workpieces takes place in the form of a slide-grinding finishing. Such drag-finishing machines are known, for example, from DE 102 04 267 C1, DE 200 05 361 U1 or DE 10 2010 052 222 A1.

DE 10 2011 103 606 A1 and DE 10 2009 021 824 A1 show additional devices for the surface finishing of large-sized workpieces, especially in the form of turbines, which comprise a rotatingly driven workpiece holder, which dips into a stationary container containing the bed of granular material. A moving unit associated with the workpiece holder ensures a rotary or alternating motion of the workpiece about the axis thereof or even different motions (rotating and oscillating motions) of the workpiece in the granular grinding material with the speed of rotation and the dipping depth being varied.

As an alternative or in addition to a translatory motion of the workpieces themselves clamped on the workpiece holders, the container containing the finishing medium may also be moved relative to the workpieces, which are, for example, rotated themselves at least about their own axis, for example, about its own axis and/or along a trajectory, e.g., in the form of a circular path. If only the container is moved and the workpieces themselves do not perform any translatory motion, this is also called "plunge-cut grinding," which thus represents a special form of drag-finishing.

To bring about automated operation, modern devices usually used for the surface finishing of the workpiece, such as the dip- and/or drag-finishing machines of the aforementioned type, comprise, as a rule, a program-based control device, which is capable of controlling at least the rotary drive of the workpiece holders as well as optionally also a translatory drive thereof and/or a (rotary) drive of the container according to different speeds of rotation, rates of motion and finishing times, which can be inputted in an input device.

DE 10 2011 015 750 A1 describes another method and a device for the surface finishing of workpieces, which is provided especially for the gentle finishing of very delicate workpieces, especially in the form of optical lenses, which must meet very narrow tolerances. The workpiece holders are carried in this case by a manipulator controllable in a programmed manner, such as an industrial robot, in order to pivot the workpiece clamped on the workpiece holder during the finishing about a plurality of different axes and to make it possible in the process to change the angle of impact at which the granular grinding and/or polishing material being moved in the container comes into contact with discrete surface areas of the workpiece and thus to ensure the desired grinding and/or polishing effect for the particular surface area of the workpiece. The manipulator is capable of rotating the workpieces clamped on the workpiece holder about the axis of the workpiece holder continually, as desired, at a constant speed of rotation or at adjustably different speeds of rotation and/or directions of rotation and/or of moving same by a translatory motion in the bed of the granular grinding and/or polishing material or even to only dip the workpiece into said bed. The container itself may comprise a controlled rotary drive in order to set it into rotation at the particular, desired speed of rotation and to change the velocity at which the granular materials meets the workpiece.

The granular grinding and/or polishing material used in grinding and polishing methods of this class may also differ, in principle, depending on the workpieces to be finished and may be, e.g., of natural origin (consist of, e.g. organic material, such as walnut or coconut shells, wood, cherry stones, etc.), of inorganic origin (consist, e.g., of silicates, oxides, etc.) and/or of synthetic origin (consist of, e.g., plastics). Moreover, it is possible, as was already indicated, to carry out the slide-grinding finishing dry or, with the addition of a liquid finishing medium, for example, water, which may be mixed with additives, e.g., surfactants, in the form of a wet finishing.

It was, however, found that unsatisfactory surface finishing of the workpieces may occur in at least some areas, which applies especially to workpieces with a relatively more complex geometry, such as one with grooves, undercuts or even with cavities of varying sizes, depressions or the like, even in case of a rotary motion of the workpieces about the axis of the workpiece holder, which may optionally occur both clockwise and counterclockwise, i.e., in different directions of rotation, wherein a translatory motion of the workpieces through the granular grinding and/or polishing material is superimposed to said rotary motion. The reason for this is mainly that the particles of the granular material are carried along by the workpiece in the immediate vicinity of the workpiece being rotated relative to the bed of granular material, so that the relative motion of the particles of granular material in relation to the workpiece is markedly lower at the surface of the workpiece than the speed of rotation of the workpiece itself (or than the speed of rotation of the bed of granular material being rotated together with the container). This is especially true, as was stated, if the workpiece is provided with surface structures, such as grooves, undercuts, etc., or if the workpiece has one or more larger cavities, in which the particles of the granular material can be deposited and carried along with the rotating workpiece.

This problem is sought to be eliminated in the state of the art mainly by the workpiece being rotated at the highest possible speed of rotation, but this requires a great effort in terms of drive technology, and the maximum speed of rotation is limited. In addition, it was found that a mere reversal of the direction of rotation is incapable of eliminating this problem completely even if the workpiece is rotated at high speeds of rotation both clockwise and counterclockwise. As far as relatively large cavities or depressions of the workpiece are concerned, as they occur, for example, in the case of workpieces in the form of bottles or other vessels or dies having a die cavity, even very high speeds of rotation are able to lead to satisfactory surface finishing of the inner walls enclosing such cavities or depressions of the workpiece only after an (excessively) long finishing time.

DE 20 2009 008 070 U1 describes a workpiece holder intended for drag-finishing machines, whose rotatable workpiece carriers, onto which the workpieces to be finished can be clamped, are arranged at a slope angle between 5° and 35° in relation to the clamping device of the workpiece holder itself, wherein the slope angle may be adjustable especially between said angle range and an angle of 0 (vertical arrangement). The deposition of particles of granular material in grooves or undercuts of the workpiece is effectively reduced in this manner, because the particles are again discharged by themselves from such surface structures of the workpiece during the operation as a consequence of the slope of the angle of rotation. However, the aforementioned problem that a velocity gradient develops here as well is likewise present here, and the relative velocity of the granular material in relation to the workpiece being rotated decreases with decreasing distance between a particle of granular material and the workpiece.

SUMMARY OF THE INVENTION

A basic object of the present invention is therefore to perfect a method and a device for the surface finishing of workpieces of the type mentioned in the introduction in a simple and cost-effective manner such that the problem of entrainment of particles of the granular material located close to the workpiece with the workpiece being rotated and resulting losses of efficiency of the surface finishing can be effectively eliminated and a satisfactory surface finishing of workpieces having relatively large cavities or depressions also becomes possible with an economically acceptable finishing time.

From a technological point of view, this object is accomplished in a method of the type mentioned in the introduction by the workpiece and/or a container containing the bed of the granular grinding and/or polishing material

- being accelerated to and fro in periodic cycles of at most 5 sec between at least one first speed of rotation and at least one second speed of rotation; and/or
- being rotated with continual acceleration with continually different speeds of rotation.

In terms of the device, the present invention makes, furthermore, provisions for accomplishing this object in a device for the surface finishing of workpieces of the type mentioned in the introduction for the control device

- to accelerate the rotary drive of the workpiece holder and/or the rotary drive of the container to and fro in periodic cycles of at most 5 sec between at least one first speed of rotation and at least one second speed of rotation; and/or
- to continually accelerate the rotary drive of the workpiece holder and/or the rotary drive of the container at continually different speeds of rotation during the operation.

The embodiment according to the present invention prevents the development of a velocity gradient of the particles of granular material in the immediate vicinity of the workpiece being rotated in a very simple and cost-effective manner by the workpiece being rotated being accelerated between different speeds of rotation in very short periodic cycles to and fro and/or at continually different speeds of rotation in relation to the bed of granular material. The workpiece and the bed of granular material contained in the container are consequently accelerated to and fro especially continually between one or more first speeds of rotation as well as one or more second speeds of rotation, and a maximum speed of rotation is preferably reached within the short periodic time intervals or cycles in order to decelerate (effect negative acceleration) hereafter and then to effect a (positive) acceleration again, etc. An especially high relative velocity, which is continually changing over time, is ensured in this manner between the workpiece and the granular grinding and/or polishing material directly on the surface of the workpiece, as a result of which a markedly increased finishing efficiency and, as a consequence, shorter finishing times can be achieved. This also applies, in particular, to workpieces with relatively large cavities or depressions, in which the particles of the granular material of the bed can be moved along after a relatively short time only together with the rotating workpiece in case of a more or less constant speed of rotation of the workpiece according to the state of the art, without an appreciable relative motion, which is, of course, absolutely necessary for a surface finishing, also developing. A possible retrofitting of prior-art drag and dip-finishing machines to the embodiment according to the present invention requires, in principle, only a modification in the programming of the control device in order to cause this to accelerate the rotary drive of the workpiece holder(s) or also of the container during the operation between different speeds of rotation in very short periodic cycles between different speeds of rotation to and fro and/or at continually different speeds of rotation.

Incidentally, "acceleration" is defined in the sense of the present invention as both a positive acceleration and a negative acceleration or deceleration of the rotating workpiece and of the workpiece holder carrying same and/or of the rotating container. "Cycles" are defined in this connection as the consecutive, identical or optionally also different, durations during the surface finishing, during which the workpiece and the bed of granular material contained in the container is moved once to and once fro between at least one first speed of rotation and at least one second speed of rotation.

Provisions may be made in an advantageous manner for the workpiece and/or the container containing the bed of granular material to be accelerated to and fro at least temporarily or at times between at least one first speed of rotation equaling essentially zero and at least one second speed of rotation not equal to zero. Accordingly, an above-described speed of rotation profile, in which the first speed of rotation equals approximately zero, is preferably set, and it is sufficient as a rule, for achieving the effect according to the present invention not to accelerate (negatively) the workpiece and the bed of granular material contained in the container to an absolute stop, but the workpiece and the container may also be accelerated (negatively), e.g., continually to a very low (first) speed of rotation of, e.g., up to about 50 rpm and preferably up to about 10 rpm and then to accelerate it again (positively) to the desired, e.g., maximum (second) speed of rotation.

As will be explained in more detail below, the speed of rotation of the workpiece and/or of the container containing the bed of granular material over time may be described in both cases preferably essentially by a sinusoidal curve (i.e., both periodically between at least two speeds of rotation to and fro and with continual acceleration with a speed of rotation changing continually over time), and the amplitude (speed of rotation) of such a sinusoidal curve may be approximately constant (e.g., between a speed of rotation approximately equal to zero and the equal maximum speed of rotation) or also different, for example, if very high (or rather low) speeds of rotation are desired for the initial rough finishing and, by contrast, lower (or higher) speeds of rotation are desired for the later fine finishing (the amplitude of such a sinusoidal curve decreases or increases, for example, with increasing finishing time in this case).

Moreover, provisions may advantageously be made for the workpiece and/or the container containing the bed of granular material to be accelerated to and fro at least temporarily or at times between at least one first speed of rotation not equal to zero and at least one second speed of rotation with a direction of rotation that is opposite the first speed of rotation. Such a reversal of the direction of rotation taking place in continually periodic cycles during the finishing prevents the formation of a velocity gradient of the particles of the granular material in the vicinity of the workpiece rotating relative to these particles in an especially efficient manner, especially also in the case of workpieces having grooves, depressions or similar surface structures. This is also true of a bed of granular material filled into a relatively large cavity or such a depression of the workpiece when the workpiece is accelerated in the aforementioned manner. The values of the speeds of rotation clockwise and counterclockwise may, in turn, be either constant or variable over the finishing time and may be equal or different from one another.

The maximum speed(s) of rotation may correspond, in principle, to the speeds of rotation that are usually set and suitable for the particular workpiece, and the workpiece and/or the container containing the bed of granular material may be accelerated especially to at least one (first and/or second) speed of rotation of at least about 200 rpm, especially at least about 500 rpm, and preferably at least about 1,000 rpm. Especially preferred maximum speeds of rotation equal at least about 1,500 rpm or especially at least about 2,000 rpm. Corresponding values apply to the value of the difference in speed between at least one first speed of rotation and at least one second speed of rotation, between which the workpiece and/or the container is accelerated to and fro.

On the occasion of the rotary motion of the workpiece and/or of the container between the at least one first speed of rotation and the at least one second speed of rotation to and fro, the periodic cycles should be selected to be as short as possible in view of an effective and time-efficient surface finishing, and provisions may preferably be made for the workpiece and/or the container containing the bed of granular material to be accelerated to and fro at least temporarily in periodic cycles of at most about 4 sec, especially at most about 3 sec, preferably at most about 2 sec, for example, at most about 1 sec or even at most about 0.5 sec between the at least one first speed of rotation and the at least one second speed of rotation.

As was indicated above, provisions are made in an especially advantageous embodiment of the method according to the present invention for the workpiece and/or a container containing the bed of the granular grinding and/or polishing material to be

- both accelerated to and fro in periodic cycles of at most 5 sec between at least one first speed of rotation and at least one second speed of rotation and
- rotated during continual acceleration at continually different speeds of rotation.

The workpiece and/or the container containing the bed of granular material are advantageously accelerated to and fro in this connection at least temporarily or at times at a speed of rotation which is described over time by an essentially sinusoidal curve, and the period or the cycle of the essentially sinusoidal curve describing the speed of rotation may equal especially at most about 5 sec (but its duration may also be longer if a continual change in the speed of rotation is ensured).

The workpiece and/or the container containing the bed of granular material may be accelerated in this case to and fro at a speed of rotation which is described over time by an essentially sinusoidal curve with an approximately constant amplitude (i.e., with an approximately constant distance between the minima and maxima of the speeds of rotation) or also with an amplitude variable over time (i.e., with different distances between the minima and maxima of the speeds of rotation).

If the latter method variant is selected and the workpiece and/or the container is accelerated to and fro at a speed of rotation that is described by an essentially sinusoidal curve with an amplitude variable over time, as it is done, for example, on the occasion of an above-mentioned initial rough grinding, which passes gradually over into a fine grinding, the amplitude of the essentially sinusoidal curve describing the speed of rotation may preferably decrease or increase over time at least temporarily, especially essentially continuously, so that the minima and maxima of the speeds of rotation converge or diverge.

Moreover, provisions may be made according to an advantageous embodiment for at least one cavity or at least one depression of the workpiece to be filled with the bed of the granular grinding and/or polishing material and for the workpiece

- to be accelerated to and fro in periodic cycles of at most 5 sec between at least one first speed of rotation and at least one second speed of rotation; and/or
- to be rotated during continual acceleration at continually different speeds of rotation about at least one axis, especially essentially about the central axis of the cavity or the depression, in order to grind and/or to polish at least the wall of the workpiece enclosing the cavity or the depression. Speed profiles of the above-mentioned type may, of course, preferably become established. Especially the inner wall of the workpiece, which encloses such cavities and/or depressions, for example, of a workpiece in the form of a die, a bottle or any other desired vessels, etc., can be ground and/or polished in this manner in a highly effective and time-efficient manner, and the bed of granular material filled into the depression/cavity of the workpiece accelerated several times to different speeds of rotation is not entrained (appreciably) by the workpiece being always rotated at different speeds based on the inertia. If only the depression or the cavity is to be subjected to surface finishing in such a workpiece, it is obvious that a device suitable for this does not necessarily have to have a container for receiving (additional) granular grinding and/or polishing material. In addition, it may be useful in such a case if the hollow workpiece is rotated about the central axis of its cavity or its depression in the manner according to the present invention, which axis may be especially essentially horizontal during the surface finishing, in order to take advantage of the gravitation of the bed of granular material.

If workpieces containing such cavities and/or depressions shall (also) be subjected to surface finishing on their outer side and/or if workpieces having only relatively small grooves/undercuts or even workpieces without such surface contours shall be subjected to surface finishing in an efficient manner in a relatively short time, provisions may, of course, advantageously be made, as an alternative or in addition, for the workpiece to be dipped in such a known manner into the bed of granular grinding and/or polishing material charged into a container and especially for the workpiece

- to be accelerated to and fro in periodic cycles of at most 5 sec between at least one first speed of rotation and at least one second speed of rotation; and/or
- to be rotated with continual acceleration with continually different speeds of rotation.

This alternative (active rotation of the workpiece itself) is usually to be given preference over a rotary motion of the container with such a speed profile because of the usual inertia of a bed of particles and the resulting delay in entrainment with a container being rotated in an accelerated manner, but it may, of course, also prove useful to provide an active rotation of the container with the bed of granular material with such a speed of rotation profile, especially in case of relatively heavy workpieces and the high torques resulting therefrom during the deceleration/acceleration of said workpieces. Moreover, a combination of the two alternatives is, of course, also conceivable, in which case the workpiece and the container should be rotated mostly in opposite directions. As will be explained below, it is, further, conceivable, for example, on the one hand, to accelerate only the workpiece in the manner according to the present invention to different speeds of rotation and to let the container be immobile or optionally to move it more or less uniformly in order to let the particles of granular material being carried by the container flow additionally to the workpiece, or, on the other hand, to accelerate only the container in the manner according to the present invention to different speeds of rotation and to let the workpiece dip into the bed of granular material container in the container as well as optionally to move the workpiece additionally more or less uniformly, e.g., by a translatory motion, etc.

Consequently, provisions may advantageously be made, especially if the workpiece is accelerated with a speed of rotation profile according to the present invention, for the container

- to be held stationary (container not moving) at least temporarily or at times; and/or
- to be moved to and fro by a translatory motion;
- to be moved by a translatory motion along a trajectory, especially along a circular path; and/or
- to be rotated rotatorily about its central axis (uniformly or at different speeds of rotation and/or in different directions of rotation).

The container is advantageously rotated in the latter case, either essentially at a constant speed of rotation or at a speed of rotation varying over time, about its central axis in order to avoid balance errors. This preferably also applies, in principle, to the workpiece being rotated.

The control device of a device according to the present invention for the surface finishing of workpieces is consequently designed preferably for setting at least one, especially a plurality of or preferably all the speed of rotation profiles of the rotary drive of the workpiece holder and/or of the container, which were explained above, during the operation.

As was mentioned above, the present invention also offers, of course, the possibility that the workpiece is moved, furthermore, i.e., in addition to the rotational acceleration of the workpiece itself or especially of the container according to the present invention, by a translatory motion, especially along a trajectory, relative to the bed of granular grinding and/or polishing material. This may be effected, for example, by the container containing the bed of granular grinding and/or polishing material being moved, especially rotated, relative to the workpiece, so that the granular grinding and/or polishing material will flow continually to the workpiece in the direction of the relative motion between said granular grinding and/or polishing material and the workpiece, especially if the workpiece, which is rotating itself, dips into the bed of granular material eccentrically in relation to the container or is also being moved by a translatory motion itself. Provisions may preferably be made in this connection in terms of the device for the control device to be designed, furthermore, to control the rotary drive of the container to a speed of rotation that is essentially constant over time, but is preferably variable or even variable over time.

As an alternative or in addition, it is also possible, for example, to provide an additional motion or oscillating drive for the container, which generates, e.g., a reciprocating translatory to-and-fro motion and is in functional connection with the control device.

As an alternative or in addition, a translatory motion of the workpiece in the bed of granular grinding and/or polishing material relative to this may take place, besides, by the workpiece being moved by a translatory motion along a trajectory, especially in the form of a circular path or also any other desired trajectory, in the bed of granular grinding and/or polishing material relative to this. The workpiece may now be moved by a translatory motion at an essentially constant speed relative to the bed of the granular grinding and/or polishing material or, of course, also at variable speed. In terms of the device, provisions may advantageously be made in this connection for associating the workpiece holder and/or the container, furthermore, with a translatory motion drive, and for the control device to be, furthermore, capable of controlling the translatory motion drive of the workpiece holder, especially along a trajectory, such as a circular path or any other desired trajectory. Such translatory motion drives of the workpiece holder are known, among other things, from the state of the art cited in the introduction and may comprise, for example, a rotating part of a drag-finishing machine, the so-called plate, at which one or more workpiece holders are arranged eccentrically; or they may also comprise, for example, manipulators carrying the workpiece holder or the workpiece holders, such as robots and the like.

As was mentioned above, provisions are also made in an advantageous embodiment of the method according to the present invention for at least the rotary motions of the workpiece and/or of the container containing the bed of granular material and optionally the additional—translatory and/or rotary—motions of the workpiece and/or of the container to be carried out in a controlled, especially programmed, manner.

Finally, especially servo motors, which may be preferably provided for the rotary drive of the workpiece holder and/or of the container of a device according to the present invention, proved to be useful for the high accelerations according to the present invention within short cycles. Depending on the weight and the moment of inertia of the workpiece and of the container, which is caused thereby, a reducing gear or a step-up gear may be associated with the rotary drive in question.

Further features and advantages of the present invention appear from the following description of exemplary embodiments with reference to the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
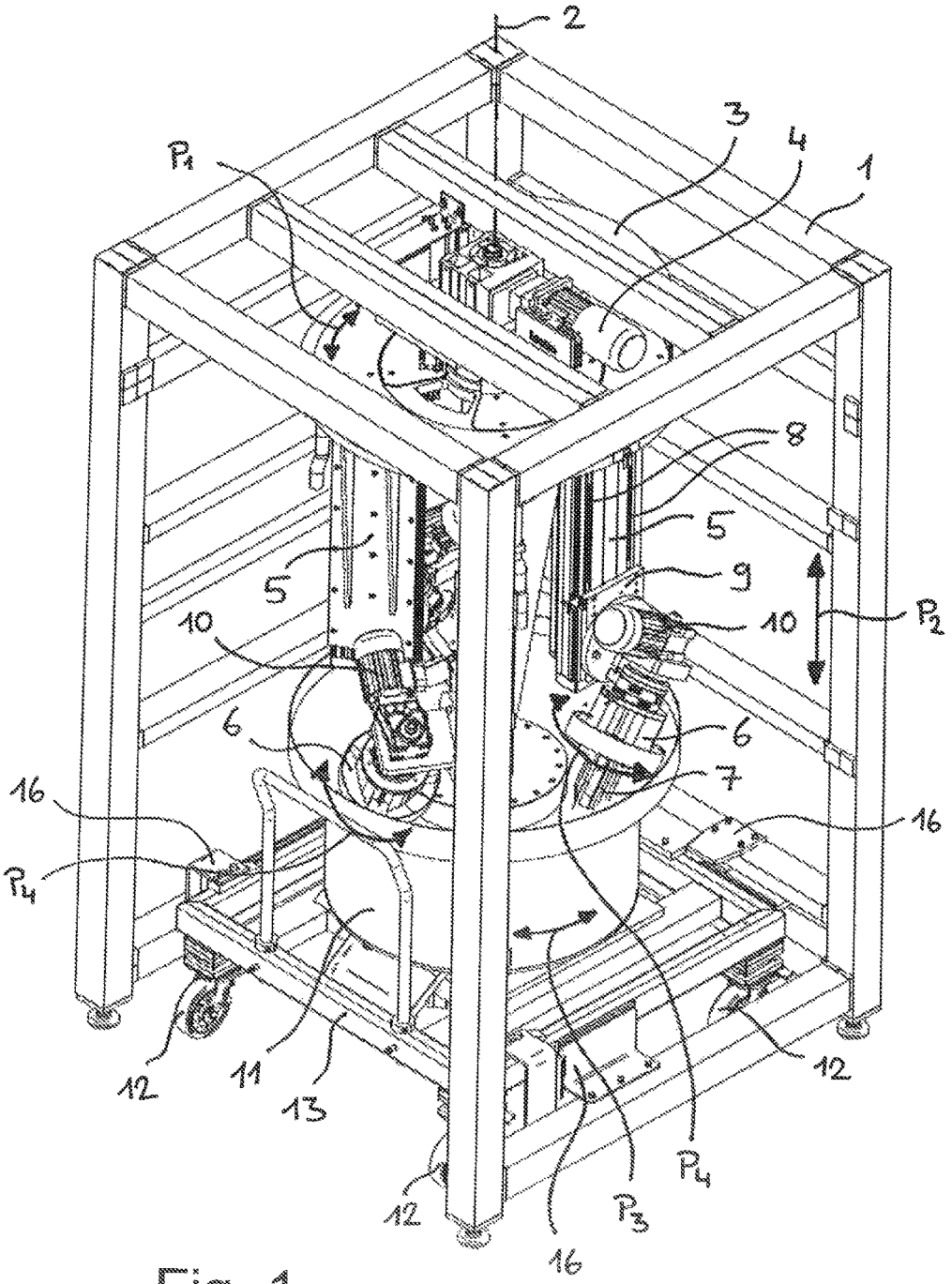
FIG. 1 is a schematic perspective view of an embodiment of a device according to the present invention for the surface finishing of workpieces in the form of a drag- or dip-finishing machine.

The exemplary embodiment of a device for the surface finishing of workpieces in the form of a drag- or dip-finishing machine, which is shown in FIG. 1, has a frame 1, at the upper end of which a part 3 rotatable to and fro about a vertical axis 2 in the direction of arrow $P_1$ in the form of a rotatable carrying plate in the manner of a plate, is mounted. The rotatable part 3 is equipped for this with a controllable motor drive 4, which is likewise fixed to the frame 1. Lifting device 5 are arranged on the underside of the rotatable part 3 eccentrically to the axis of rotation 2 of said part and in the circumferential direction of said part one after another at equal distances from one another as well as at equal radial distance from the axis of rotation 2 of the rotatable part 3, with three such lifting devices 5 being provided in the present exemplary embodiment, but it is also possible, of course, to provide only two or more than three lifting devices 5. The lifting devices 5 carry a workpiece holder 6 each, which may be provided, for example, with one clamping device 7 or with a plurality of clamping devices 7 each in order to be able to detachably clamp the workpieces to be finished (not shown) on the occasion of their surface finishing. The drive 4 of the rotatable part 3 can be used in this manner as a translatory motion drive of the workpiece holders 6, which are arranged eccentrically at the rotatable part 3 and which are moved along a circular path during a rotation of the part 3.

Each lifting device 5 comprises in the present exemplary embodiment, e.g., a carrying unit 9, which can be displaced to and fro along a vertical guide 8 and which can be moved upward and downward, for example, by means of a chain or belt drive. Furthermore, the lifting devices 5 can be moved in the present exemplary embodiment upward and downward independently from one another individually and independently from the other lifting devices 5 by means of a motor (not recognizable in the drawings) likewise fastened on the underside of the rotatable part 3. Each of the workpiece holders 6 is fixed on the vertically displaceable carrying unit 9, and the workpiece holders 6 can be set into rotation by means of a controllable rotary drive 10 each in order to set a workpiece, which is clamped on the workpiece holder 6, e.g., by means of the clamping device 7, into rotation on the occasion of the surface finishing thereof (arrow $P_4$).

A container for receiving a granular grinding and/or polishing material (not shown), which can be rotated by means of a rotary motion drive about a vertical axis, is arranged under the lifting device 5 equipped with the workpiece holders 6, the axis of rotation of the container 11 being aligned here, e.g., with the axis of rotation 2 of the rotatable part 3, so that the relative motion caused by this between the workpiece fixed at the workpiece holders 6 and the bed of granular material contained in the container 11 is the same. Each lifting device 5 is capable of displacing the workpiece holder 6 fastened to its carrying unit 9 vertically to and fro along the arrow $P_2$ between an upper position, which is arranged above the container 11 and in which finished workpieces can be removed from the clamping device 7 of the respective workpiece holder 6 and this clamping device can be fitted with raw workpieces, and a lower position, in which the workpieces 17 clamped on the clamping device 7 of the workpiece holders 7 dip into the container 11 in order to enable these workpiece to be finished.

In addition, the rotatable part 3 can be moved in the direction of arrow $P_1$ about its axis 3 such that it is capable of moving each workpiece holder 6 with a particular workpiece fastened thereto one after another into a fitting/removal position, wherein such a fitting/removal position is assumed, for example, by the workpiece holder 6 shown on the right side in FIG. 1, in which position the workpiece holder 6 is freely accessible from the side after it has been moved by the lifting device 5 into its upper position.

As is also shown in FIG. 1, the workpiece holders 6 with their clamping devices 7 may be sloped at a finite angle in relation to the vertical direction, and this angle equals, e.g., approximately 30° in this case. This has proved in many cases to be advantageous concerning a uniform and effective surface finishing. The slope angle of the workpiece holders 6 may be individually adjustable by, e.g., the carrying unit 9 of each lifting device 5, which said carrying unit carries the particular workpiece holder 6, being pivotable about an axis, which is approximately horizontal here. It is usually advantageous in this connection if the workpiece holders 6 have a slope direction component arranged opposite the direction of rotation of the container 11 (arrow $P_3$), i.e., the workpieces fixed on the workpiece holders 6 dip into the bed of granular material present here with a slope opposite the direction of rotation of the container 11, so that a surface finishing of the lower end face of the workpieces can take place as well.

As can, furthermore, be determined from FIG. 1, the container 11 containing the granular grinding and/or polishing material may be arranged on a carriage 13 displaceable by means of rollers 12 in this exemplary embodiment in order to ensure a simple and rapid replacement of the granular material by replacing a container 11 with another container. The carriage 13 comprises the rotary drive of the container 11 arranged, e.g., on its underside (not visible in FIG. 1). To ensure accurate alignment of the container 11 in relation to the device being carried by the frame 1, both the carriage 13 and the frame 1 may be equipped with mutually complementary centering devices 16, which are arranged, for example, on three of four sides of the carriage 13 and of the frame 1 and ensure self-centering of the carriage 13 in relation to the frame 1 when the carriage 13 is pushed laterally into the frame 1. so that the axis of rotation of the container 11 coincides with the axis of rotation 2 of the rotatable part 3.

The device comprises, furthermore, a program-based control device (not shown in the drawing), which may be, for example, an electronic data processing unit with a processor and which is capable of controlling the rotary drives 10 of the workpiece holders 6 such that it accelerates the latter during the operation in periodic cycles Z of at most 5 sec to and fro between at least one first speed of rotation $R_1$ and at least one second speed of rotation $R_2$ and/or rotates them with continual acceleration at continually different speeds of rotation, wherein the corresponding, desired rotary motion profiles can be advantageously programmed and entered into an input unit (likewise not shown in the drawing) of the control device. Moreover, provisions may, e.g., also be made for the control device to be capable of controlling the control device of the rotary drive of the container 11 in such a manner that it accelerates the latter to and fro during the operation in periodic cycles Z of at most 5 sec between at least one first speed of rotation $R_1$ and at least one second speed of rotation $R_2$ and/or rotates same with continual acceleration at continually different speeds of rotation, wherein the desired rotation profiles can thus also be advantageously programmed and entered into the input unit of the control device. Exemplary rotary motion profiles will be explained below as examples with reference to FIGS. 3 and 4. The control device is capable, furthermore, of controlling the rotary motion drive of the container 11 such as to impose on it a more or less desired, more or less constant speed (or speeds) of rotation and/or direction (or directions) of rotation.

Moreover, the control device is functionally connected to both the drive 4 of the rotatable part 3 and the drives of the lifting device 5, and, for example, the desired finishing times of the workpieces as well as the fitting/removal position including the residence time of each workpiece holder 6 in the fitting/removal position can be entered in the input unit of the control device. The control device may be designed such that it displaces the rotatable part 3 in periodic time intervals in order to transfer each workpiece holder 6 after the particular preset finishing time into the fitting/removal position and to hold it there over a likewise preset time period sufficient for the removal/fitting of workpieces. A semi-continuous workpiece fitting and removal is achieved in this way. The control device ensures in this connection, furthermore, that each lifting device 5 of the respective workpiece holder 6, at the clamping device 7 of which the particular workpiece(s) shall just be replaced now, is displaced vertically upwardly from the lower working position into the upper fitting/removal position by means of the rotatable part 3 after, before or during the displacement of the workpiece holders 6 by means of the rotatable part, is held there over a likewise preset time period sufficient for the removal/fitting of workpieces, and then transferred again vertically downwardly into the working position, after, before or during the displacement of the workpiece holders 6 by means of the rotatable part 3.

Figure 2:
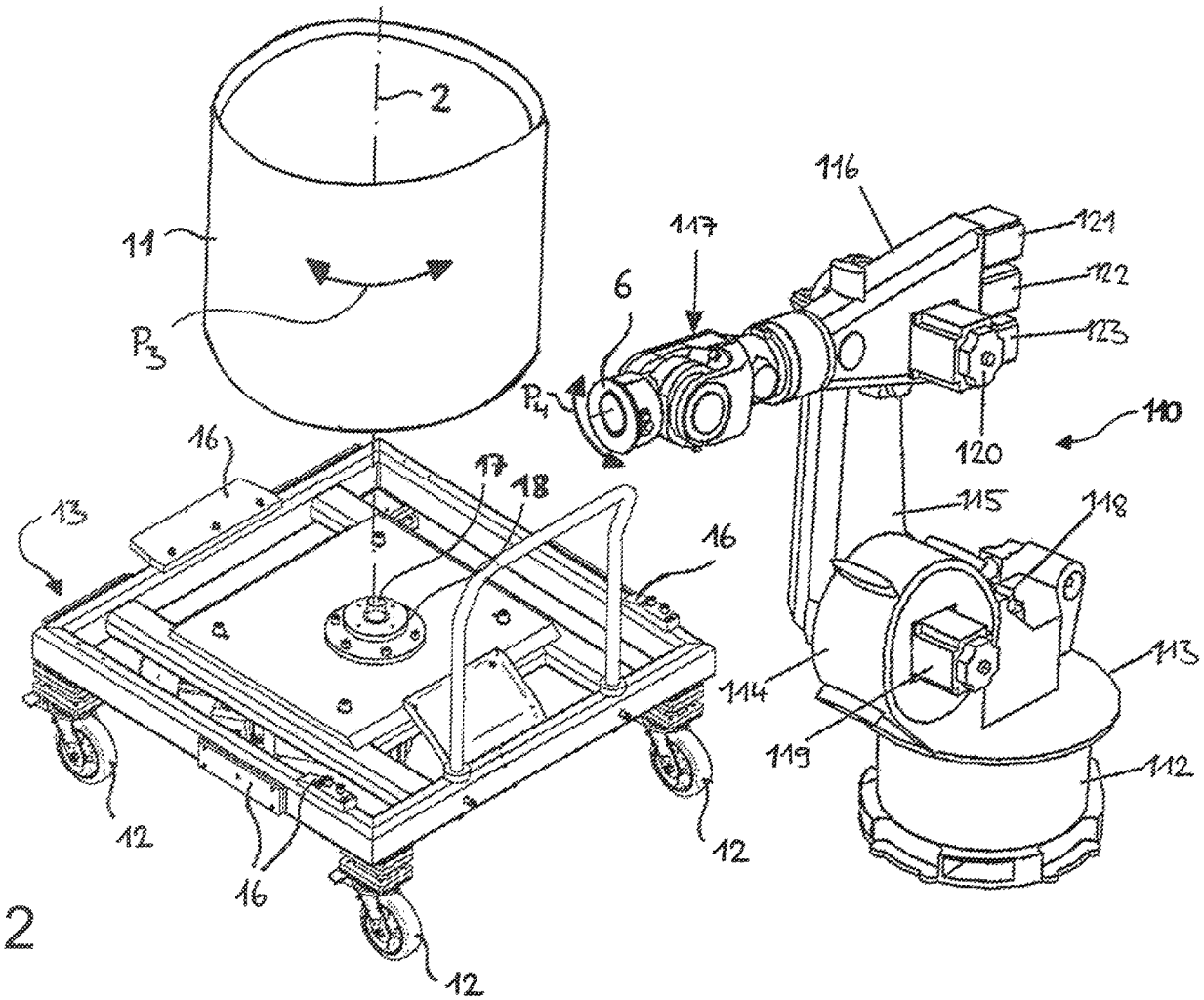
FIG. 2 is a schematic perspective exploded view of another embodiment of a device according to the present invention for the surface finishing of workpieces.

FIG. 2 shows another embodiment of a device for the surface finishing of workpieces, wherein identical or functionally identical components are designated by the same reference numbers as in FIG. 1. The device according to FIG. 2 comprises again a container 11 containing a granular grinding and/or polishing material (not shown), which is rotatable about a vertical axis 2 by means of a rotary motion drive. The container 8 is arranged in this exemplary embodiment on a carriage 13, which corresponds to the carriage 13 according to FIG. 1 and on which, e.g., on the underside of which, the rotary drive (not fully recognizable in FIG. 2) of the container 11 is again arranged, and which carriage 13 comprises a carrying plate 18, which is equipped with a carrier shaft 17 and on which the container 11 can be placed in a nonrotatable and self-centering manner.

The device shown in FIG. 2 comprises, furthermore, a manipulator designated by the reference number 110 as a whole in the form of a robot, which carries the workpiece holder 6 or workpiece holders 6 for detachably fixing a workpiece (not shown) to be finished. The robot 110 is, for example, a multiaxial industrial robot, which has a frame 112, on which a carrousel 113 is mounted pivotably about a vertical axis. On the carrousel 113 is seated a bracket 114 with a horizontal mount for a rocker 115, at the (upper) end of which facing away from the bracket 114 an extension arm with a horizontal axis arranged in parallel to the pivot axis of the bracket 114 is mounted. The extension arm, 116 is equipped at its end with a three-axis robot hand 117, which carries the workpiece holder 6. While the carrousel 113 is driven via a pilot motor 118 in relation to the stationary frame 112, a pilot motor 119 is used to drive the rocker 115 and a pilot motor 120 is used to drive the extension arm 116. The three-axis robot hand 117 is driven by three additional pilot motors 121, 122, 123, which are mounted, e.g., at the end of the extension arm 116 facing away from the robot hand 117.

The three-axis robot hand 117 with the workpiece holder 6 is consequently capable both of pivoting the latter in the three-dimensional space in any desired orientation in order to align a workpiece detachably fixed to the workpiece holder 6 in the desired position in relation to the bed of granular material present in the container 11, and of moving the workpiece holder 6 by a translatory motion in any desired direction in space. Moreover, the three-axis robot hand 117 is capable of rotating the workpiece holder 6 especially in the direction of arrow $P_4$ about its longitudinal axis, the rotary motion control being again designed such that it is capable of accelerating the workpiece holder 6 with a workpiece fixed thereto to and fro during the operation in periodic cycles Z of at most 5 sec between at least one first speed of rotation $R_1$ and at least one second speed of rotation $R_2$ and/or of rotating it with continual acceleration at continually different speeds of rotation (see below in this connection with reference to FIGS. 3 and 4), and the corresponding, desired rotary motion profiles can be programmed and entered in an input unit (likewise not shown in the drawing). This can, in turn, also apply to the rotary motion control of the container 11.

Figure 3:
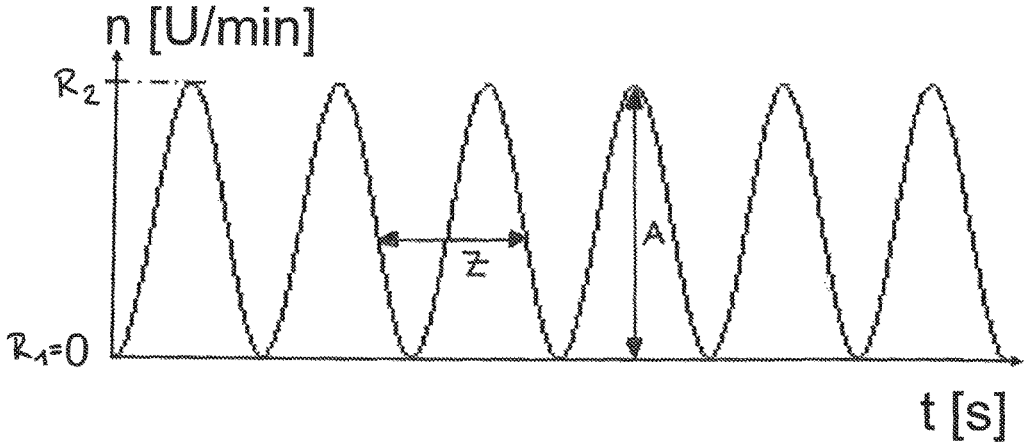
FIG. 3 is a diagram of an exemplary embodiment of an advantageous speed of rotation profile of a workpiece holder with a workpiece clamped thereon over time that can be set by the control during the operation of the devices according to FIGS. 1 and/or 2.
Figure 4:
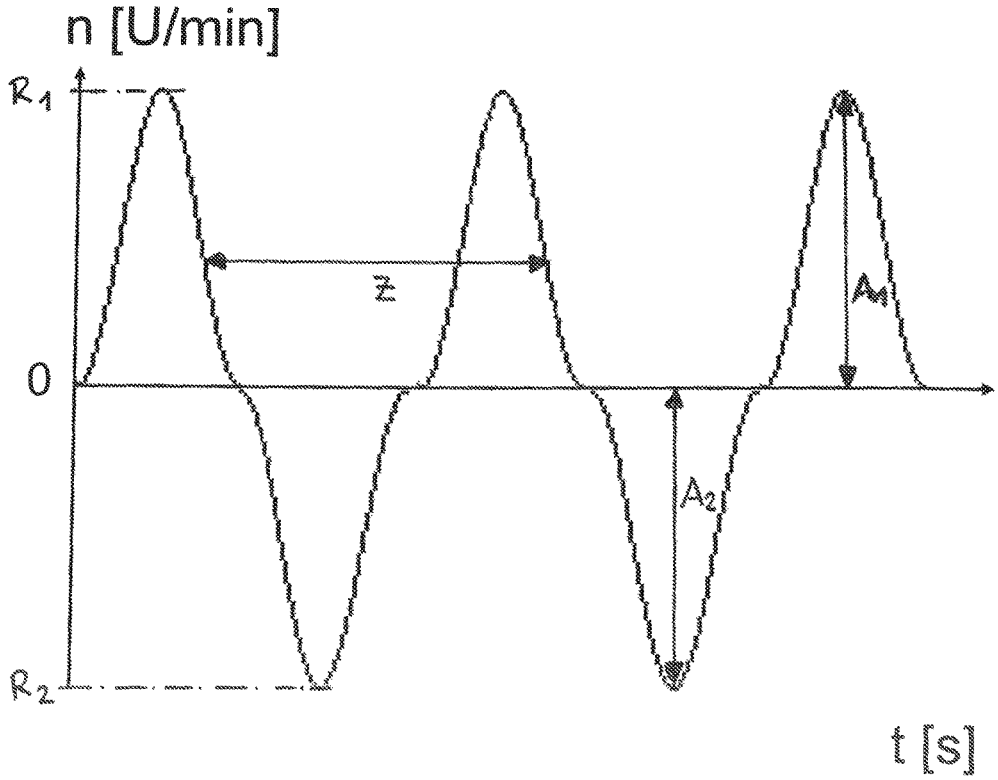
FIG. 4 is a diagram of an exemplary embodiment of another advantageous speed of rotation profile, which diagram corresponds to FIG. 3.

FIGS. 3 and 4 show examples of advantageous speed of rotation profiles of the workpiece holder 6 (and/or of the container 11), as they can be carried out by means of the devices according to FIGS. 1 and 2. The speed of rotation n representative of the speed of rotation (e.g., in revolutions® per minute (min)) against the finishing time t (e.g., in seconds (s)) on the x axis is plotted on the y axis in the diagrams in FIGS. 3 and 4. As is apparent from FIG. 3, the speed of rotation profile of the workpiece holder 6 and of the workpiece clamped thereon (or also of the container 11) is described there essentially by a sinusoidal curve or in the form of a non-attenuated oscillation, and the workpiece is accelerated to and fro in periodic cycles Z continually with continuous (positive or negative) acceleration between a first speed of rotation $R_1$ of approximately zero and a second speed of rotation $R_2$, which may equal, for example, about 2,000 rpm. The second speed of rotation does not, however, have to be necessarily constant, but it may also vary over the finishing time t, i.e., the amplitude A of the approximately sinusoidal curve may change with increasing finishing time (not shown). Likewise, the first speed of rotation $R_1$ does not necessarily have to equal zero, but it may especially also be a markedly lower speed of rotation compared to the second speed of rotation $R_2$, e.g., between approximately 0 and about 100 rpm. The duration of the periodic cycles Z may be, for example, between about 1 sec and about 10 sec. The speed of rotation profile of the workpiece holder 6 and of the workpiece clamped thereon (or also of the container 11), which is shown as an example in FIG. 4, differs from that according to FIG. 3 mainly in that the workpiece is accelerated to and fro in periodic cycles Z continually between a first speed of rotation $R_1$ not equal to zero and a second speed of rotation $R_2$, which is likewise not equal to zero, but with opposite direction of rotation. The shape of the curve is likewise essentially sinusoidal with a flattening due to inertia in the range of stop (n=0), when the direction of rotation is reversed. The rotary motion, in turn, takes place with continual (positive or negative) acceleration. The values of the first $R_1$ and/or second speed of rotation $R_2$ may again equal, for example, approximately 2,000 rpm, but they also may differ from one another as desired, and they may do so not only in their sign. Again, the two speeds of rotation $R_1$, $R_2$ do not necessarily have to be constant, but one speed of rotation or both speeds of rotation $R_1$, $R_2$ may also change over the finishing time t, i.e., the "amplitude component" $A_1$ of the first speed of rotation $R_1$ up to the zero point (stopping of the workpiece at one point during the reversal of the direction of rotation) and/or the "amplitude component" $A_2$ of the second speed of rotation $R_2$ up to the zero point of the approximately sinusoidal curve may change with increasing finishing time (not shown). The duration of the periodic cycles Z may be, for example, between about 0.25 sec and about 5 sec.

While specific embodiments of the invention have been shown and described in detail to illustrate the application of the principles of the invention, it will be understood that the invention may be embodied otherwise without departing from such principles.

The invention claimed is:

1. A method for the surface finishing of workpieces by the workpiece being moved relative to a bed of a granular grinding and/or polishing material, the method comprising the steps of:

detachably fastening the workpiece on a workpiece holder;

dipping the workpiece into the bed of granular grinding and/or polishing material being charged into a container;

rotating the workpiece holder with the workpiece about at least one axis in relation to the bed of granular grinding and/or polishing material; and accelerating and decelerating the workpiece holder with the workpiece to different speeds of rotation in relation to the bed of granular grinding and/or polishing material via a rotary drive of the workpiece holder, wherein the workpiece holder with the workpiece is rotated with continual acceleration and deceleration with continually different speeds of rotation by a program-based control device configured for controlling the rotary drive of the workpiece holder, wherein the workpiece holder with the workpiece is rotated in periodic cycles of at most 5 seconds between at least one first speed of rotation and at least one second speed of rotation, wherein at least one of the periodic cycles is defined as consecutive durations during the surface finishing, during which the workpiece holder with the workpiece is moved once between the at least one first speed of rotation and the at least one second speed of rotation.

2. A method in accordance with claim 1, wherein the workpiece holder with the workpiece is accelerated and decelerated between at least one first speed of rotation essentially equal to zero and at least one second speed of rotation not equal to zero.

3. A method in accordance with claim 1, wherein the workpiece holder with the workpiece is accelerated and decelerated between at least one first speed of rotation not equal to zero and at least one second speed of rotation with a direction of rotation opposite that of the first speed of rotation.

4. A method in accordance with claim 1, wherein the workpiece holder with the workpiece is accelerated to at least one speed of rotation of at least 200 rpm.

5. A method in accordance with claim 1, wherein the workpiece holder with the workpiece is accelerated and decelerated at a speed of rotation based on an essentially sinusoidal curve over time, wherein the period or the cycle of the essentially sinusoidal curve of the speed of rotation equals at most 5 seconds.

6. A method in accordance with claim 5, wherein the workpiece holder with the workpiece is accelerated and decelerated at a speed of rotation based on an essentially sinusoidal curve over time with an approximately constant amplitude.

7. A method in accordance with claim 5, wherein the workpiece holder with the workpiece is accelerated and decelerated at a speed of rotation based on an essentially sinusoidal curve over time with an amplitude that is variable over time.

8. A method in accordance with claim 7, wherein the amplitude of the essentially sinusoidal curve describing the speed of rotation over time decreases or increases.

9. A method in accordance with claim 1, wherein at least one cavity or at least one depression of the workpiece is filled with the bed of the granular grinding and/or polishing material when the workpiece is dipped into the bed of granular grinding and/or polishing material and the workpiece holder with the workpiece is accelerated and decelerated at least about one axis of the cavity or of the depression of the workpiece with continual acceleration and deceleration at continually different speeds of rotation, in order to grind and/or polish at least a wall of the workpiece enclosing the cavity or the depression.

10. A method in accordance with claim 9, wherein the workpiece is accelerated and decelerated about the at least one axis of the cavity or of the depression of the workpiece in the periodic cycles of at most 5 seconds between at least one first speed of rotation and at least one second speed of rotation.

11. A method in accordance with claim 1, wherein the container containing the bed of granular grinding and/or polishing material is rotated with continual acceleration and deceleration with continually different speeds of rotation.

12. A method in accordance with claim 1, wherein the container is at least one of:

held stationary;

moved by a translatory motion;

moved by a translatory motion along a trajectory, especially along a circular path; and rotated rotatorily about its central axis.

13. A method in accordance with claim 1, wherein the container is rotated at least rotatorily about its central axis.

14. A method in accordance with claim 13, wherein the container is rotated about its central axis at a speed of rotation that is essentially constant or changes over time.

15. A method in accordance with claim 1, wherein the workpiece holder with the workpiece is moved, furthermore, by a translatory motion, along a trajectory, relative to the bed of the granular grinding and/or polishing material.

16. A method in accordance with claim 1, wherein at least the rotary motion of the workpiece holder is carried out in a controlled programmed-based manner.

17. A method in accordance with claim 16, wherein the rotary motion of the container containing the bed of granular material is carried out in a controlled programmed-based manner.

18. A method in accordance with claim 1, further comprising:

providing a carriage comprising a container rotary drive configured to actuate the container, the carriage comprising carriage centering devices;

providing a frame comprising frame centering devices;

inserting the carriage in the frame such that the frame centering device cooperate with the carriage centering device to center the carriage relative to the frame.

19. A method for the surface finishing of workpieces, the method comprising the steps of:

providing a workpiece holder comprising a rotary drive;

providing a container comprising a bed of granular grinding and/or polishing material;

detachably fastening a workpiece on the workpiece holder;

moving the workpiece into the container;

continuously changing a rotational speed of the workpiece with the workpiece holder connected thereto via the rotary drive from a start of a grinding and/or polishing process to an end of the grinding and/or polishing process after the workpiece is moved into the container, wherein the workpiece holder with the workpiece is rotated in periodic cycles of at most 5 seconds between at least one first speed of rotation and at least one second speed of rotation, wherein at least one of the periodic cycles is defined as consecutive durations during the surface finishing, during which the workpiece holder with the workpiece is accelerated and decelerated once while rotating the workpiece holder with the workpiece between the at least one first speed of rotation and the at least one second speed of rotation.

20. A method in accordance with claim 19, wherein continuously changing the rotational speed of the workpiece includes accelerating and decelerating the workpiece holder with the workpiece to different speeds of rotation in relation to the bed of granular grinding and/or polishing material via the rotary drive, wherein the workpiece holder with the workpiece is rotated with continual acceleration and deceleration with continually different speeds of rotation via a program-based control device configured for controlling the rotary drive of the workpiece holder.

21. A method in accordance with claim 19, further comprising:

providing a carriage comprising a container rotary drive configured to actuate the container, the carriage comprising carriage centering devices;

providing a frame comprising frame centering devices;

inserting the carriage in the frame such that the frame centering device cooperate with the carriage centering device to center the carriage relative to the frame.

22. A method for the surface finishing of workpieces, the method comprising the steps of:

providing a workpiece holder comprising a rotary drive;

providing a container comprising a bed of granular grinding and/or polishing material;

detachably fastening a workpiece on the workpiece holder;

moving the workpiece into the container for carrying out a granular grinding and/or polishing process;

rotating the workpiece holder with the workpiece at a rotational speed after the workpiece is moved into the container from a start of the granular grinding and/or polishing process to an end of the granular grinding and/or polishing process, wherein the rotational speed is continually varied from the start of the granular grinding and/or polishing process to the end of the granular grinding and/or polishing process, wherein the workpiece holder with the workpiece is rotated in periodic cycles of at most 5 seconds between at least one first speed of rotation and at least one second speed of rotation, wherein at least one of the periodic cycles is defined as consecutive durations during the surface finishing, during which the workpiece holder with the workpiece is accelerated and decelerated once while rotating the workpiece holder with the workpiece between the at least one first speed of rotation and the at least one second speed of rotation.

23. A method in accordance with claim 22, wherein continually varying the rotational speed of the workpiece includes accelerating and decelerating the workpiece holder with the workpiece to different speeds of rotation in relation to the bed of granular grinding and/or polishing material via the rotary drive, wherein the workpiece holder with the workpiece is rotated with continual acceleration and deceleration with continually different speeds of rotation via a program-based control device configured for controlling the rotary drive of the workpiece holder.

* * * * *